US005181328A

United States Patent [19]

Bouverie

[11] Patent Number: 5,181,328

[45] Date of Patent: Jan. 26, 1993

[54] WALL-MOUNTED HAIR DRYER

[75] Inventor: Alain P. C. Bouverie, Cerizy-La-Foret, France

[73] Assignee: Moulinex (Societe Anonyme), Bagnolet, France

[21] Appl. No.: 798,145

[22] Filed: Nov. 26, 1991

[30] Foreign Application Priority Data

Dec. 6, 1990 [FR] France ..... 90 15312

[51] Int. Cl.[5] ..... A45D 20/08

[52] U.S. Cl. ..... 34/97; 34/55; 34/54; 392/381

[58] Field of Search ..... 34/3, 90, 91, 96, 97, 34/98, 55, 54; 248/314, 315, 293, 674; 392/380, 381, 382, 384

[56] References Cited

U.S. PATENT DOCUMENTS

| | | | |
|---|---|---|---|
| 4,659,907 | 4/1987 | Andis et al. | 248/674 |
| 4,735,002 | 4/1988 | Rath | 34/97 |
| 4,757,183 | 7/1988 | Karey et al. | 34/97 |
| 4,802,287 | 2/1989 | Chen | 34/97 |
| 4,939,345 | 7/1990 | Farina et al. | 34/97 |

*Primary Examiner*—Henry A. Bennett
*Assistant Examiner*—Denise L. F. Gromada
*Attorney, Agent, or Firm*—Young & Thompson

[57] ABSTRACT

A hair dryer comprises a housing (1) of which one portion comprises a mounting for securement on a wall (P), and which contains a hot air generator group (3–4) controlled by a switch (5) and adapted to establish a current of air between an air inlet opening (6) and a hot air outlet opening (7). The hot air outlet opening receives a connector (8) secured to a flexible tube (9) provided with a drying nozzle (10) which can be brought, either into a retracted or rest position in which the switch is open, or into a use position in which the switch is closed. The connector (8) is rotatably movably mounted on the air outlet opening (7), and comprises an actuator (14) for the switch (5) such that the movement of the nozzle (10) from its retracted or rest position to its use position brings, by transmission of the movement of the nozzle to the connector by the flexible tube, the switch into its closed position, and vice versa.

6 Claims, 1 Drawing Sheet

P
1
1b
2
5
6
8
9
10
12
13
14
15
18

1
1a
7
8
15
15'
16
17

1
1a
1b
3
4
5
6
7
8
13
14
15
15'
18
A

P
1
2
5
8
9
10
12
14
15
18

WALL-MOUNTED HAIR DRYER

FIELD OF THE INVENTION

The invention relates to hair dryers comprising a housing of which one portion comprises means for securement on a vertical surface such as for example a wall, and which contain a group comprising a hot air generator with a motor-driven fan controlled by an electrical switch and adapted to establish an air current between an air inlet opening and a hot air outlet opening.

It concerns more particularly hair dryers in which the hot air outlet opening receives a connector secured to a flexible tube provided with a hair drying nozzle which can be placed, either in a retracted or rest position in which the switch is in open condition, or in a use position in which the switch is in closed position and permits drying of the hair.

BACKGROUND OF THE INVENTION

In known hair dryers of this type, the electric switch is generally mounted in a recess of the housing and is directly controlled by the nozzle during its removal from the recess, and conversely. This type of control is dangerous because if the user forgets to replace it or if it becomes displaced by accident, the generator group operates continuously and can catch fire in certain cases, for example during misfunction of the motor-driven fan.

Moreover, it will be understood that this type of switch control requires, during manufacture of the hair dryer, a precise positioning and adjustment of said switch so as to guarantee its open condition whenever the nozzle is replaced.

The present invention has particularly the object of overcoming these drawbacks.

SUMMARY OF THE INVENTION

According to the invention, the connector is rotatably movably mounted on said hot air outlet opening, and comprises actuating means for the switch such that the movement of the drying nozzle from its retracted or rest position to its use position brings, by transmission of the movement of said nozzle to the connector by means of the flexible tube, the switch into its closed position, and vice versa.

Thanks to this arrangement, the pivoting of the connector is subordinated to the spatial position of the nozzle and automatically opens the switch when the nozzle is brought to the retracted or rest position.

BRIEF DESCRIPTION OF THE DRAWINGS

The characteristics and advantages of the invention will become more apparent from the description which follows, by way of example, with reference to the accompanying drawing, in which.

DETAILED DESCRIPTION OF THE INVENTION

Figure 2:
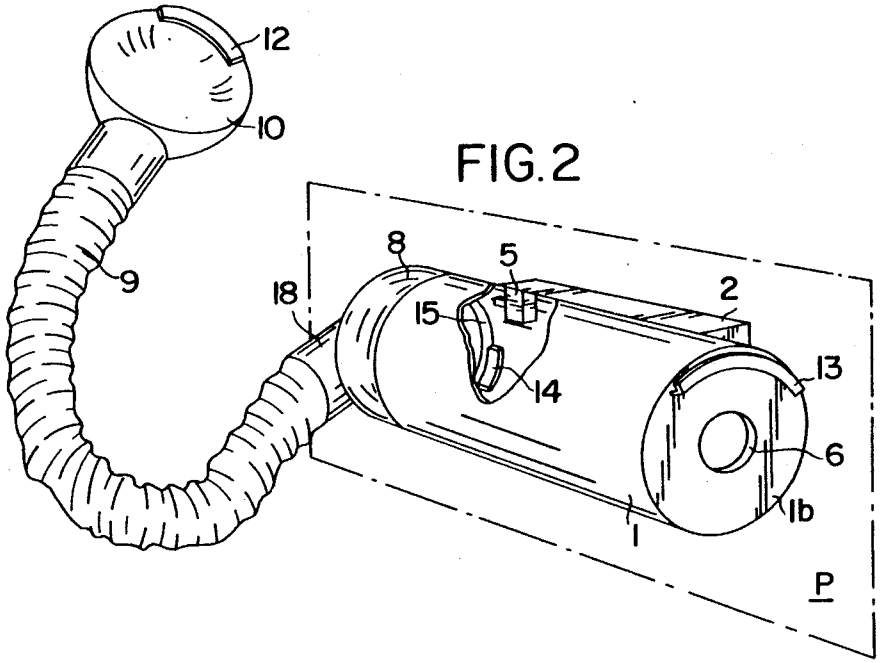
FIG. 2 is a view similar to FIG. 1, but showing the nozzle in its use position.

The illustrated hair dryer comprises a housing 1 having a generally cylindrical form whose end closures 1*a*–1*b* are open and of which the region of its lateral surface has a protrusion 2 carrying means for removable securement on a vertical surface P such as, for example, a wall so as to maintain said cylinder in a substantially horizontal position and parallel to said vertical surface. The securement means (not shown) can be lugs adapted to hook onto hooks secured on the wall.

The housing 1 contains a hot air generator group with a motor ventilator 3 of the type with an electric resistance winding 4. Said group 3–4 is controlled by an electric switch 5 and is adapted to establish an air current between the end connections 1*a*–1*b* which have respectively ambient air inlet opening 6 and hot air outlet opening 7. The hot air outlet opening 7 receives a connector 8 secured to a flexible tube 9 provided with a nozzle 10 for drying hair, which can be brought either into a retracted position (shown in full line in FIG. 1) or rest position (shown in broken line in FIG. 1) in which the switch 5 is in an open condition (cutting out the current to the hot air generator group), or to a use position (FIG. 2) in which the switch 5 is in a closed condition (supplying current to the hot air generator group), and permits drying of the hair.

As is better shown in FIG. 2, the blowing nozzle 10 and the wall of 1*b* have the air inlet opening 6 comprising mutual interengaging means such as a hook 12 secured to the nozzle 10 and a support 13 secured to the wall of 1*b*, the flexible tube 9 thus having in its retracted position a U shape.

According to the invention, the connector 8 is rotatably movably mounted on the hot air outlet opening 7, and comprises actuating means 14 for the switch 5 such that the passage of the drying nozzle 10 from its retracted or rest position (FIG. 1) to its use position (FIG. 2) brings, by transmission of the movement of said nozzle 10 to the connector 8 by means of the flexible tube 9, the switch 5 to its closed position, and vice versa.

Figure 4:
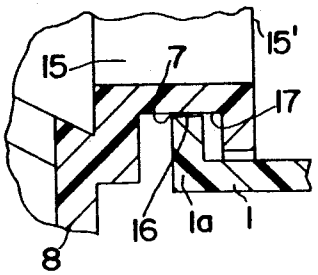
FIG. 4 shows on a larger scale the detail A in FIG. 3.
Figure 3:
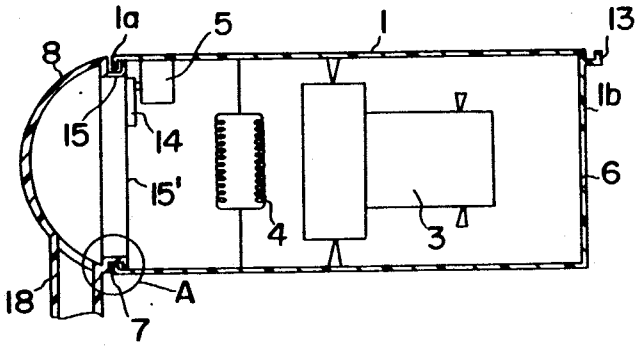
FIG. 3 is a schematic representation of a cross section of a hair dryer according to the invention to illustrate its internal parts.

To permit rotation and mounting of the connector 8 on the hot air outlet opening 7, the invention provides as better shown in FIG. 4, that said opening 7 provides by its inner edge a cylindrical bearing 16 with a substantially horizontal axis and parallel to the vertical surface P, and the connector 8 has a ring 15 of complementary shape mounted rotatably on said bearing about said axis, the bearing 16 and the ring 15 comprising mutual retention means constituted by the encasement of the edge forming the bearing 16 within a U-shaped groove 17 provided in the ring 15. As is seen in the drawing, the connector 8 has the form of an elbow whose one end comprises the ring 15 which bears on its peripheral edge 15' directed toward the switch and the actuating means 14 of the switch 5, and whose other end 18 receives the flexible tube 9.

Figure 1:
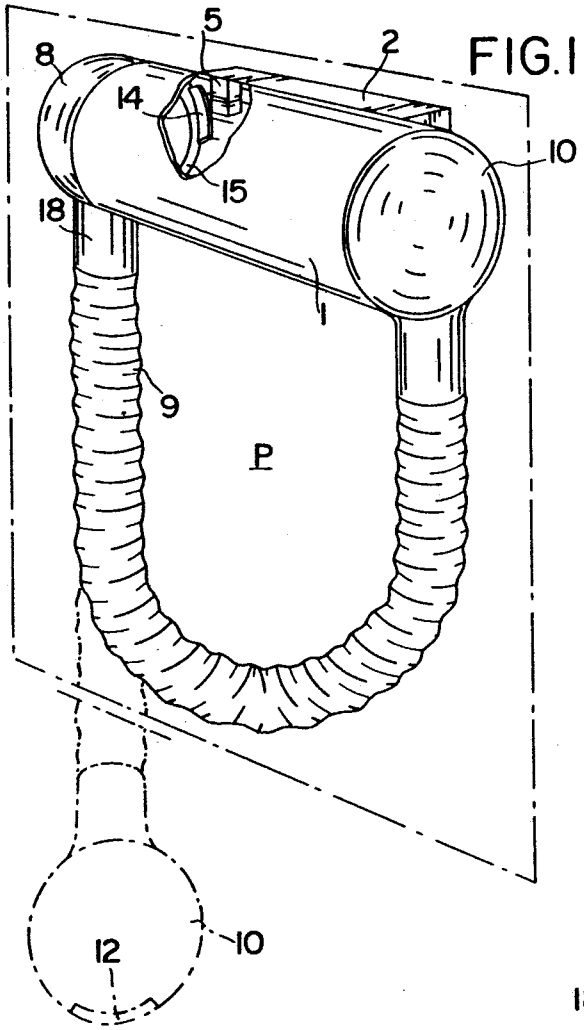
FIG. 1 is a perspective view of a hair dryer according to the invention with the drying nozzle in retracted position and with a portion of the housing broken away to illustrate the actuating means of the switch.

As shown in the broken away portions of FIGS. 1 and 2, the actuating means 14 of the switch 5 is constituted by a blade which extends about the arc of a circle concentric with the ring 15 and angularly defined with regard to the position of the switch 5 in the housing.

To describe the operation of the hair dryer, let us consider the nozzle 10 to be in its retracted position (shown in full line in FIG. 1).

When the user desires to use the hair dryer, he unhooks the nozzle 10 from the wall of 1*b*, then brings it in the direction of his head, into the use position. This movement of the nozzle away from the vertical surface P is accompanied by displacement of the tube 9 whose end connected to the connector 8 sets up a torque causing rotation of said connector on the bearing 16. This rotation of the connector moves the blade 14 from its position shown in FIG. 1 in which it maintains the switch 5 in its open position, to a position shown for example in FIG. 2 and in which it frees the switch 5 which automatically moves into its closed condition thus supplying the hot air generator 3–4.

The dimensioning and angular position of the blade 14 relative to the switch 5 are chosen such that the switch will pass from its open to its closed position as soon as the user removes the nozzle 10 from the vertical surface P.

When the user wishes to interrupt drying, he can either hang the nozzle 10 on the hook 13 (retracted position), or let hang the nozzle and the tube 9 along the vertical surface (rest position) as is illustrated in broken line in FIG. 1. These two positions effect reverse rotation of the connector 8 and thereby bring the blade 14 into contact with the switch 5 which then moves to its open condition ensuring stoppage of the hot air generator group 3–4. There is thus obtained great safety of use.

What is claimed is:

1. Hair dryer comprising a housing (1) having securement means for mounting on a vertical surface (P), said housing containing a hot air generator group with a motor ventilator (3–4) controlled by an electric switch (5) and adapted to establish a current of air between an air inlet opening (6) and a hot air outlet opening (7) receiving a connector (8) secured to a flexible tube (9) provided with a hair drying nozzle (10), said nozzle being, either into a retracted or rest position in which the switch (5) is in an open condition, or into a use position in which the switch is in a closed position and permits drying of the hair; wherein the connector (8) is rotatably movably mounted on said hot air outlet opening (7), and comprises actuating means (14) for the switch (5) such that the movement of the drying nozzle (10) from its retracted or rest position to its use position brings, by transmission of the movement of said nozzle (10) to the connector (8) by means of the flexible tube (9), the switch (5) into its closed position, and such that the movement of the drying nozzle from its use position to its retracted or rest position brings, also by transmission of the movement of said nozzle to the connector, the switch into its open position.

2. Hair dryer according to claim 7, wherein the hot air outlet opening (7) comprises a cylindrical bearing (16) with an axis substantially horizontal and parallel to the vertical surface (P), and the connector (8) has a ring (15) of complementary shape mounted rotatably on the bearing (16) about said axis, the bearing (16) and the ring (15) comprising mutual retention means.

3. Hair dryer according to claim 8, wherein the connector (8) has the general shape of an elbow of which one end comprises the ring (15) which carries on its peripheral edge (15') said actuating means (14) of the switch (5), and whose other end (18) receives the flexible tube (9).

4. Hair dryer according to claim 8, wherein the actuating means (14) of the switch (5) is constituted by a blade which extends according to the arc of a circle which is concentric to the ring (15) and which is defined angularly with respect to the position of the switch (5) in the housing (1) such as to ensure that the switch will be open only when the nozzle (10) occupies its retracted or rest position.

5. Hair dryer according to claim 7, wherein the housing (1) has a general cylindrical shape and comprises a side surface and end closures (**1*a*–1*b*), said end closures being open to form the air inlet (6) and outlet (7) openings respectively, and one portion of the side surface having a projection (2**) carrying said securement means for mounting on the vertical surface (P) so as to maintain said cylinder in a substantially horizontal position and parallel to said vertical surface.

6. Hair dryer according to claim 11, wherein the drying nozzle (10) and the end closure (**1*b*) which forms the air inlet opening (6) include mutual engaging means (12 and 13) for maintaining the nozzle (10**) in its retracted position.

* * * * *